US009728327B2

(12) United States Patent
Shen et al.

(10) Patent No.: US 9,728,327 B2
(45) Date of Patent: Aug. 8, 2017

(54) EXTERNAL ON-LOAD TAP CHANGER

(71) Applicants: Xu Shen, Shanghai (CN); Riming Xiao, Shanghai (CN)

(72) Inventors: Xu Shen, Shanghai (CN); Riming Xiao, Shanghai (CN)

(73) Assignee: SHANGHAI HUAMING POWER EQUIPMENT CO., LTD, Shanghai (CN)

( * ) Notice: Subject to any disclaimer, the term of this patent is extended or adjusted under 35 U.S.C. 154(b) by 103 days.

(21) Appl. No.: 14/078,067

(22) Filed: Nov. 12, 2013

(65) Prior Publication Data

US 2014/0291130 A1 Oct. 2, 2014

(30) Foreign Application Priority Data

Nov. 13, 2012 (CN) ..... 2012 1 0453982
Mar. 20, 2013 (CN) ..... 2013 1 0091416

(51) Int. Cl.
*H01H 9/02* (2006.01)
*H01F 29/04* (2006.01)
*H01H 9/00* (2006.01)

(52) U.S. Cl.
CPC ..... *H01F 29/04* (2013.01); *H01H 9/0027* (2013.01); *H01H 9/0044* (2013.01)

(58) Field of Classification Search
USPC ..... 200/293; 174/17 R
See application file for complete search history.

(56) References Cited

U.S. PATENT DOCUMENTS

2005/0092588 A1* 5/2005 Josten et al. ..... 200/293
2007/0252495 A1* 11/2007 Cheng et al. ..... 312/350
2011/0109177 A1* 5/2011 Crevling, Jr. ..... 310/71

* cited by examiner

*Primary Examiner* — Renee S Luebke
*Assistant Examiner* — Ahmed Saeed
(74) *Attorney, Agent, or Firm* — John P. White; Cooper & Dunham LLP

(57) ABSTRACT

Disclosed is a suspensible external combined on-load tap changer, including: a switch box, a switch body and a motor mechanism, a top box wall of the switch box being opened with a top opening, a top box cover being mounted on the top opening, wherein the switch body is detachably mounted in the switch box and is entirely lifted in and lifted out by the top opening; and the motor mechanism is connected with the switch body in a driving manner. The switch body in the present invention uses a hoisting structure, and the top box wall of the switch box is opened with a top opening with a size large enough, so that the switch body is directly lifted in and lifted out of the switch box from the top opening, and installation and maintenance are easier.

17 Claims, 12 Drawing Sheets

Amplified A in FIG. 5A

Amplified B in FIG. 7A

Amplified C in FIG. 8A

Amplified D in FIG. 8A

Amplified E in FIG. 8A

Amplified F in FIG. 9A

Amplified H in FIG. 9A

Amplified M in FIG. 10A

EXTERNAL ON-LOAD TAP CHANGER

BACKGROUND OF THE INVENTION

Field of the Invention

The present invention relates to the technical field of transformer on-load tap changers, and in particular, to an external combined on-load tap changer.

Related Art

The on-load tap changer achieves the purpose of changing the output voltage of the transformer by changing a winding tap connecting the transformer and changing the turn ratio of primary and secondary windings in the case that the transformer is on load (i.e., no power outage).

In the traditional technology, the combined on-load tap changer usually includes a change-over switch and a tap selector; the change-over switch is above, the tap selector is below, the middle is connected mechanically, which are entirely placed in the transform oil tank from the transformer cover flange hole. The change-over switch is generally a cylindrical member, sealed in its own separate cylindrical oil chamber, the tap selector usually is a cage structure, with terminals thereon, used for correspondingly connecting transformer coil taps, directly immersed in the insulating medium of the transformer oil tank.

Such a structure has the following disadvantages.

The transformer needs to reserve a switch position, so that the volume of the transformer increases. If the change-over switch oil chamber is leaking or damaged, it may pollute the transformer oil, resulting in larger losses and accidents.

The existing external on-load tap changer is only composite, such a composite switch combines switching and selection functions, that is, transition contacts, arcing contacts, transition resistors and main contacts are composite on a movable contact assembly, and the actions of transition and switching are performed once through rotation of the spindle of the switch. Due to structural reasons, the composite switch is often only applicable to on-load tap changers with lower voltage and small capacity, not suitable for use requirements of high voltage and large current.

Moreover, the existing combined on-load tap changer only has a Y-type connection manner, and for a large Δ connected transformer, 3 switches need to be selected, each controlling one phase therein, resulting in that the volume of the transformer increases, wiring is difficult, and the cost increases.

The external combined on-load tap changer has its unique advantages, for example, it has an individual oil chamber separated from the transformer, transportation can be separated from that of the transformer, and the like.

The switch body (core) of the external combined on-load tap changer in the prior art is directly mounted in the switch box, and the switch body is inseparable from the whole box, which brings about inconvenience to installation, repair and maintenance of the switch.

SUMMARY OF THE INVENTION

Objective: in order to overcome the shortcomings of the prior art, the present invention provides an external combined on-load tap changer, to facilitate installation, repair and maintenance of the switch.

The technical problem to be solved by the present invention can be implemented through the following technical solution.

An external combined on-load tap changer is provided, including: a switch box, a switch body and a motor mechanism, a top box wall of the switch box being opened with a top opening, a top box cover being mounted on the top opening, characterized in that, the switch body is detachably mounted in the switch box and is entirely lifted in and lifted out by the top opening; and the motor mechanism is connected with the switch body in a driving manner.

In a preferred embodiment of the present invention, a front box wall of the switch box is opened with a front mounting port, and a front box cover is mounted on the front mounting port.

In a preferred embodiment of the present invention, one side of the front cover is mounted on the switch box through a hinge mechanism.

In a preferred embodiment of the present invention, a rear box wall of the switch box is provided with at least two switch body mounting plates, an upper portion of each switch body mounting plate is opened with a combined mounting positioning hole; the switch body has a bottom plate, a positioning nail is disposed at a location of the bottom plate corresponding to the combined mounting positioning hole on each switch body mounting plate; and the switch body is mounted in the switch box, the positioning nail is hanged in the combined mounting positioning hole.

In a preferred embodiment of the present invention, the number of the switch body mounting plate is two, and the two switch body mounting plates are respectively fixed on left and right sides of the rear box wall of the switch box.

In a preferred embodiment of the present invention, the combined mounting positioning hole includes a round hole, a middle connecting slot hole and a transverse curved hole, wherein the round hole is located at the top of the combined mounting positioning hole, the middle connecting slot hole is located at a middle position of the combined mounting positioning hole, the transverse curved hole is located at the bottom of the combined mounting positioning hole, the middle connecting slot hole connects the round hole and the transverse curved hole; the positioning nail includes a positioning nail disc and a disc connecting rod portion integrally formed, wherein the disc connecting rod portion is fixed on the bottom plate of the switch body; a diameter of the positioning nail disc is greater than a diameter of the disc connecting rod portion, widths of the middle connecting slot hole and the transverse curved hole but less than an inner diameter of the round hole, and the diameter of the disc connecting rod portion is less than the widths of the middle connecting slot hole and the transverse curved hole.

In a preferred embodiment of the present invention, an upper portion and a lower portion of each switch body mounting plate are respectively provided with internal thread holes, bolt holes are disposed at locations on the bottom plate of the switch body corresponding to the internal thread holes, and the switch body can be fixedly mounted in the switch box by using bolts to pass through the bolt holes on the bottom plate of the switch body to be screwed into the internal thread holes on the switch body mounting plate and tightened.

In a preferred embodiment of the present invention, the switch body includes a bottom plate and a first vertical slab and a second vertical slab fixed on two sides of the bottom plate, a change-over switch and a tap selector are disposed in a space consisting of the first vertical slab and the second vertical slab of the bottom plate, and the change-over switch and the tap selector are supported by the first vertical slab and the second vertical slab; an outer side of the first vertical slab is provided with a composite sheave mechanism controlling actions of the change-over switch and the tap selector; the bottom plate is provided with terminal posts;

and the composite sheave mechanism is connected with the motor mechanism in a driving manner, In a preferred embodiment of the present invention, the tap changer and the tap selector are disposed in parallel in an axial direction and in a triangular relationship in a horizontal direction, the change-over switch is above, and the tap selector is below.

In a preferred embodiment of the present invention, the tap selector includes an odd number of sets of tap selectors and an even number of sets of tap selectors, the odd number of sets of tap selectors and the even number of sets of tap selectors are disposed in parallel in an axial direction and are separately disposed on left and right sides or upper and lower sides below the tap selector.

In a preferred embodiment of the present invention, the composite sheave mechanism controls actions of an odd number of sets of tap selectors, an even number of sets of tap selectors and the change-over switch and a phase relationship between their actions.

In a preferred embodiment of the present invention, the first vertical slab and the second vertical slab are casted or welded by metallic materials.

In a preferred embodiment of the present invention, the first vertical slab and the second vertical slab are molded by insulating materials.

In a preferred embodiment of the present invention, a vacuum contact assembly plays a transition role in the tap changer.

Due to the use of the above technical solution, the switch body of the present invention uses a hoisting structure, and the top box wall of the switch box is opened with a top opening with a size large enough, so that the switch body is directly lifted in and lifted out of the switch box from the top opening, and installation and maintenance are easier.

Moreover, compared with the prior art, the present invention has the following significant advantages.

1. Disposing the tap changer and the tap selector in parallel in an axial direction and in a triangular relationship in a horizontal direction can greatly increase the horizontal insulation distance between phases of the switch, which achieves the design requirements of the switch for high voltage and large current, and also achieves that the external on-load tap changer can adapt to the transformer Δ connection, so that the traditional function that Δ connection arrangement can be performed with three single-phase the external combined on-load tap changers can be implemented only with one according to the present invention.

2. The whole combined on-load tap changer is disposed outside the transformer, thus reducing the volume of the transformer, simplifying the wiring of windings, reducing the cost, and facilitating maintenance of the switch, and the maintenance does not require oil drain and hanging hood of the transformer.

3. The switch oil chamber and the transformer oil tank are independently separated, which may not pollute the transformer oil if a problem occurs in the switch.

DETAILED DESCRIPTION OF THE EMBODIMENTS

The present invention are further described below in combination with the accompany drawings and specific embodiments.

Figure 1:
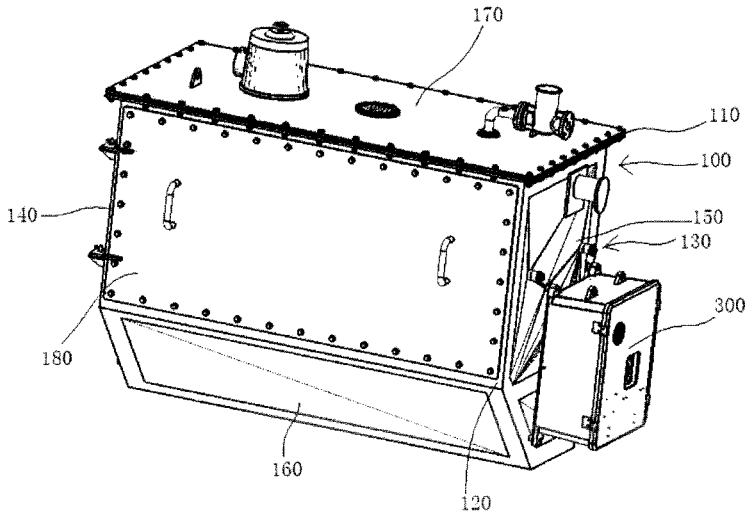
FIG. 1 is a schematic outline view of an external on-load tap changer.
Figure 2:
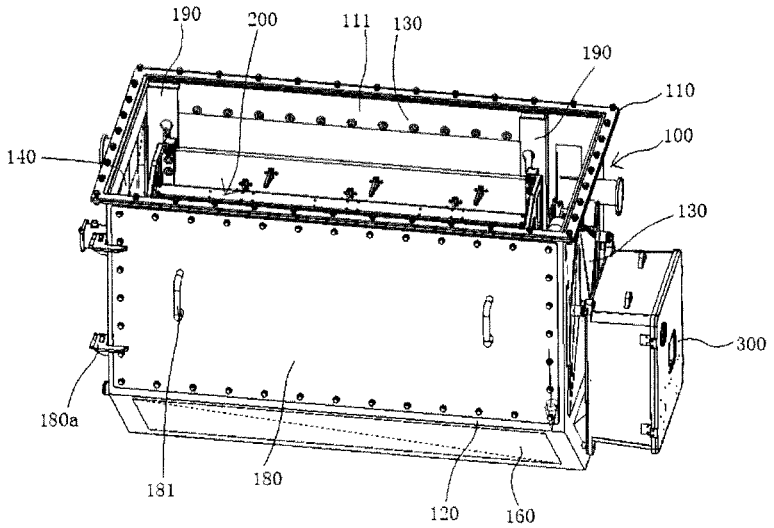
FIG. 2 is a schematic structural view of a suspensible external on-load tap changer after removal of a top box cover.
Figure 3:
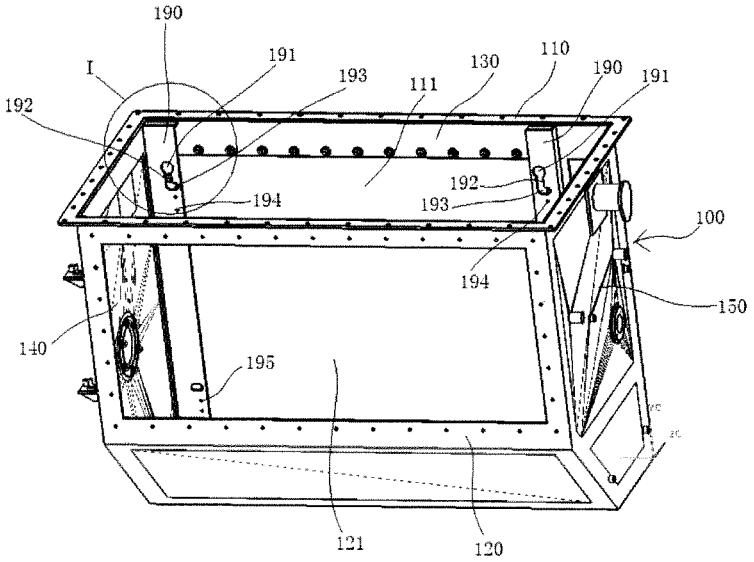
FIG. 3 is a schematic structural view of a switch box of an external on-load tap changer after removal of a top box cover and a front box cover.
Figure 4:
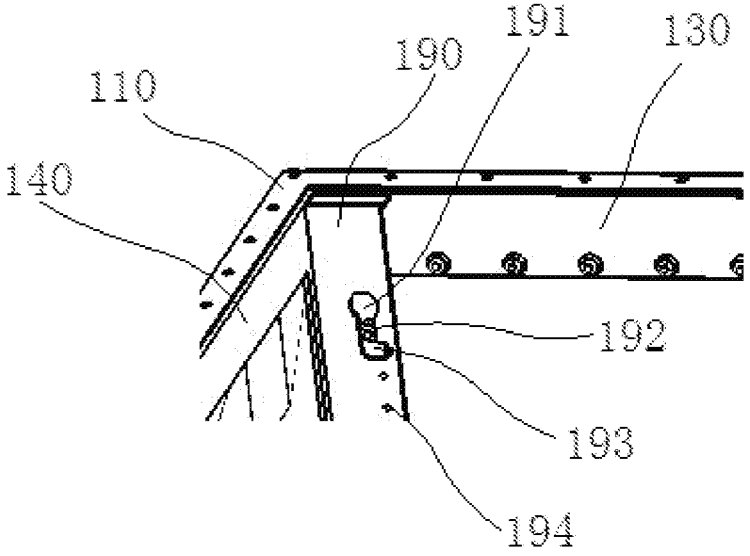
FIG. 4 is a schematic enlarged view of I in FIG. 3.
Figure 5A:
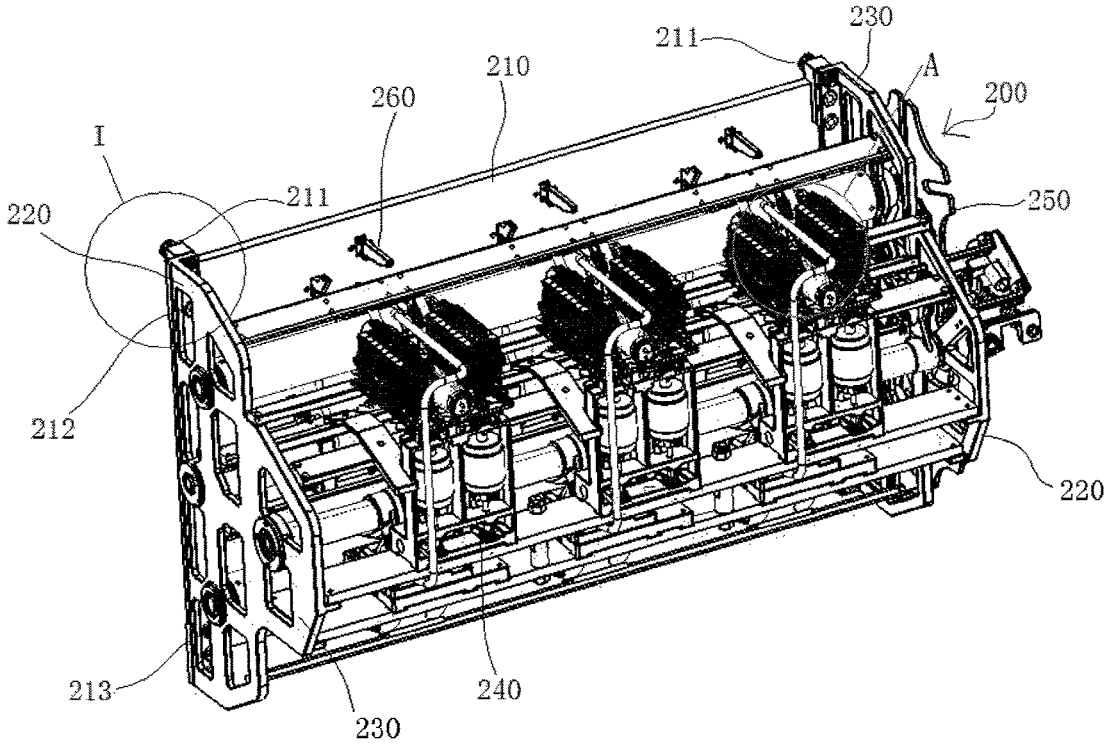
FIG. 5A is a schematic view of a structural shape of a switch body from one angle.
Figure 5B:
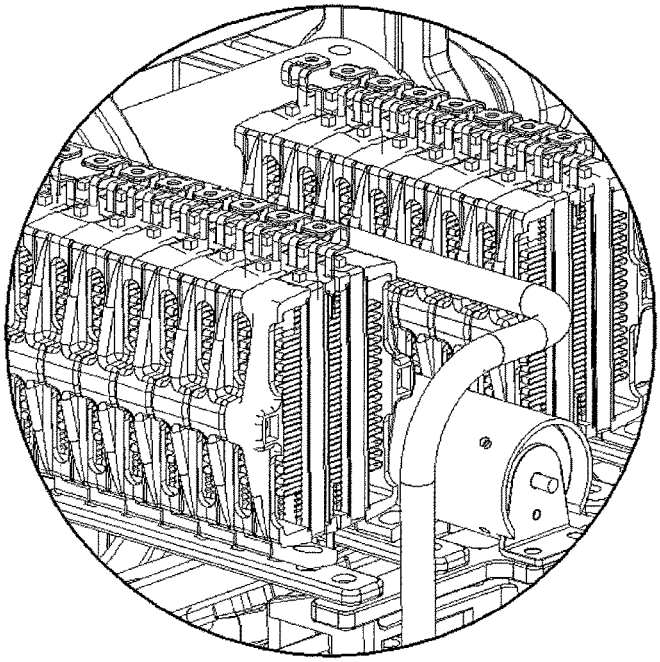
FIG. 5B is an enlarged view of A in FIG. 5A.
Figure 6:
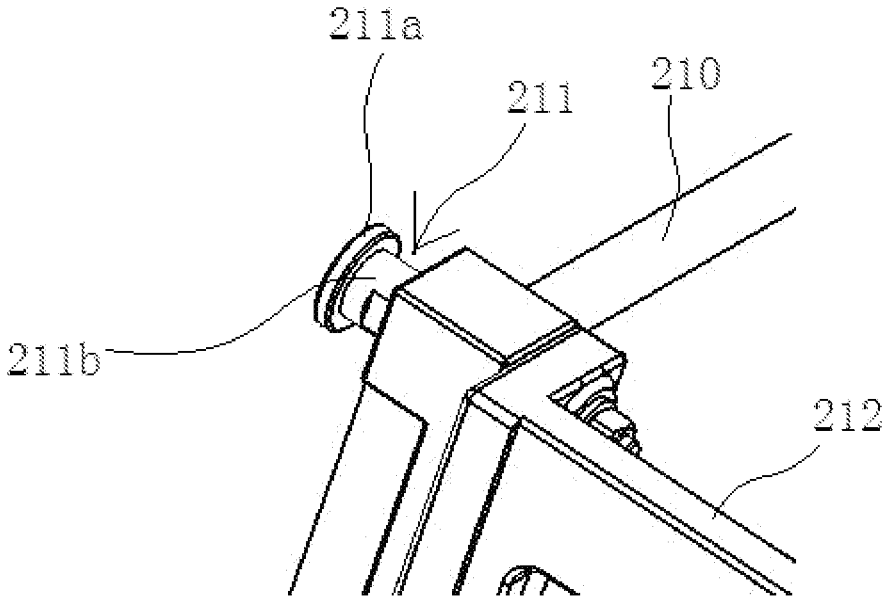
FIG. 6 is a schematic enlarged view of I in FIG. 5.
Figure 7A:
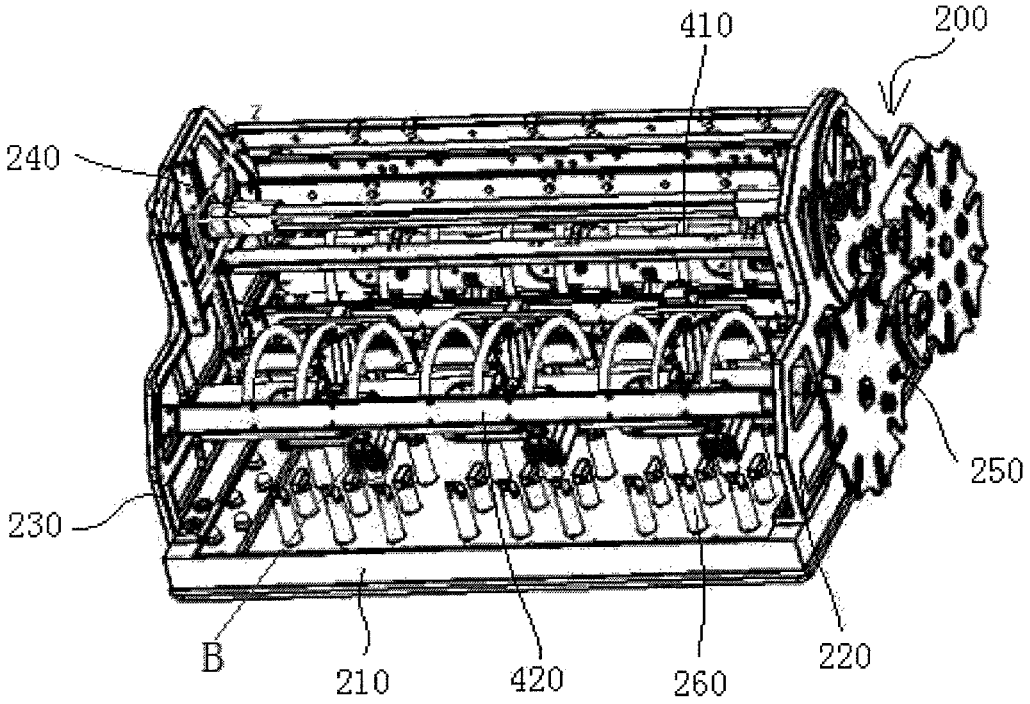
FIG. 7A is a schematic view of a structural shape of a switch body from another angle.
Figure 7B:
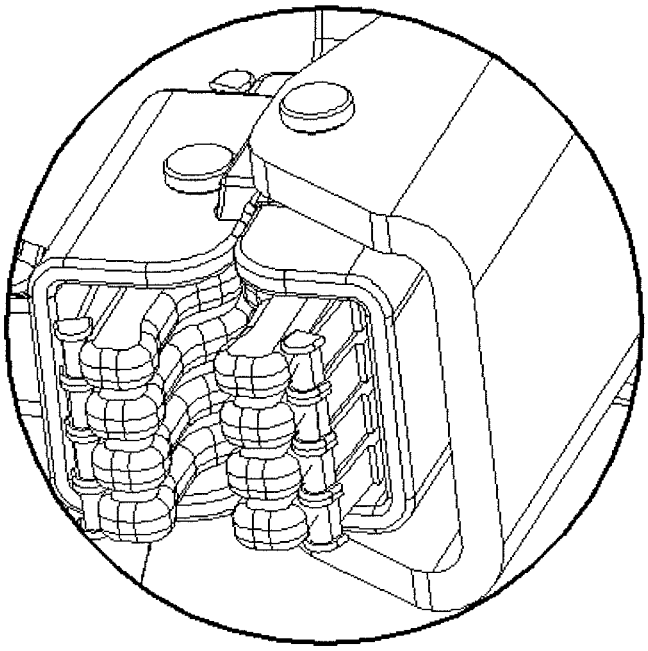
FIG. 7B is an enlarged view of B in FIG. 7A.
Figure 8A:
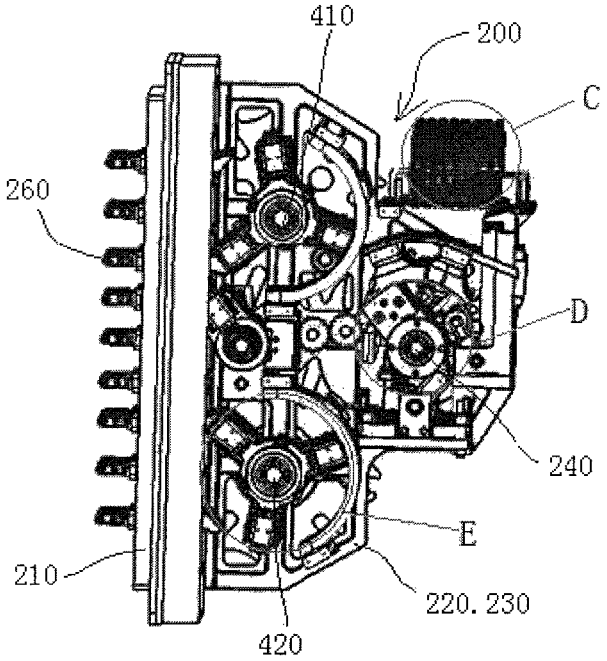
FIG. 8A is a schematic view of a cross section of a switch body according to the present invention.
Figure 8B:
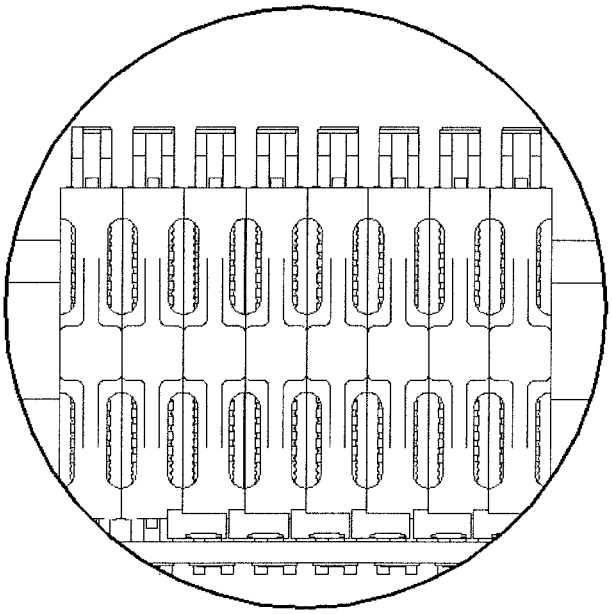
FIG. 8B is an enlarged view of C in FIG. 8A.
Figure 8C:
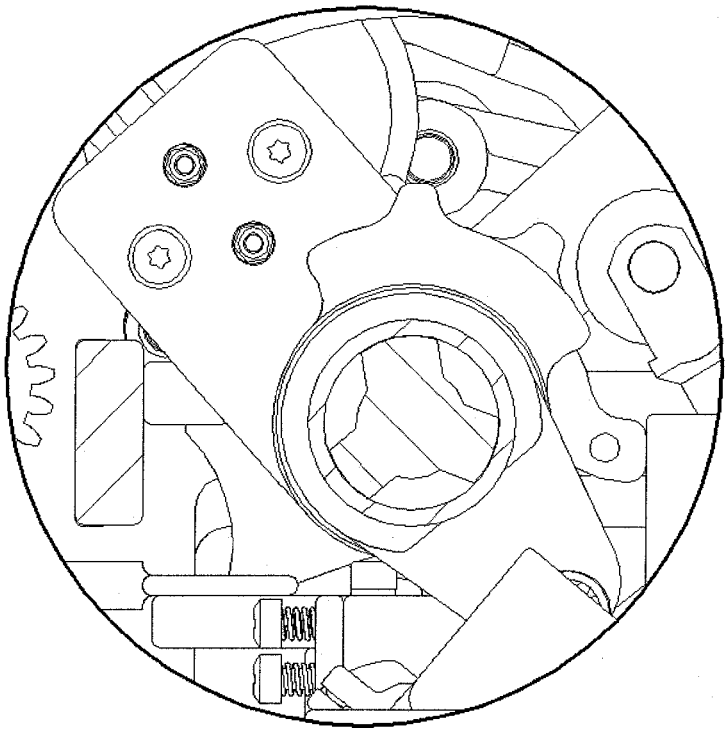
FIG. 8C is an enlarged view of D in FIG. 8A.
Figure 8D:
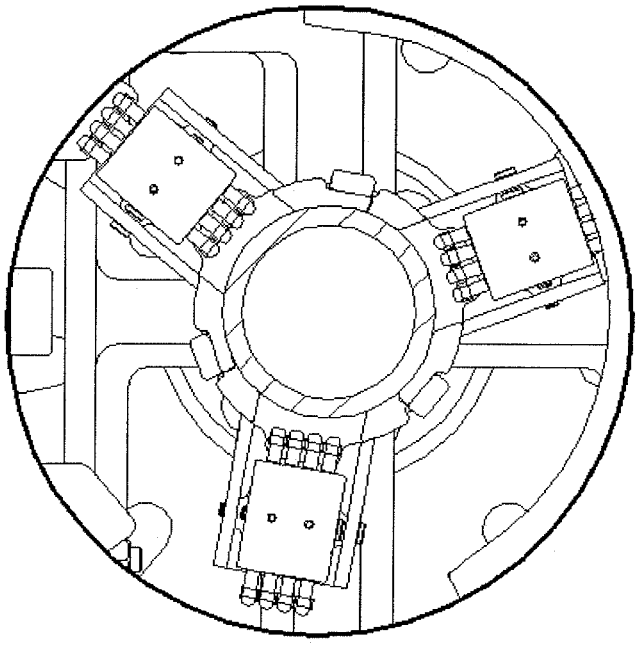
FIG. 8D is an enlarged view of E in FIG. 8A.
Figure 9A:
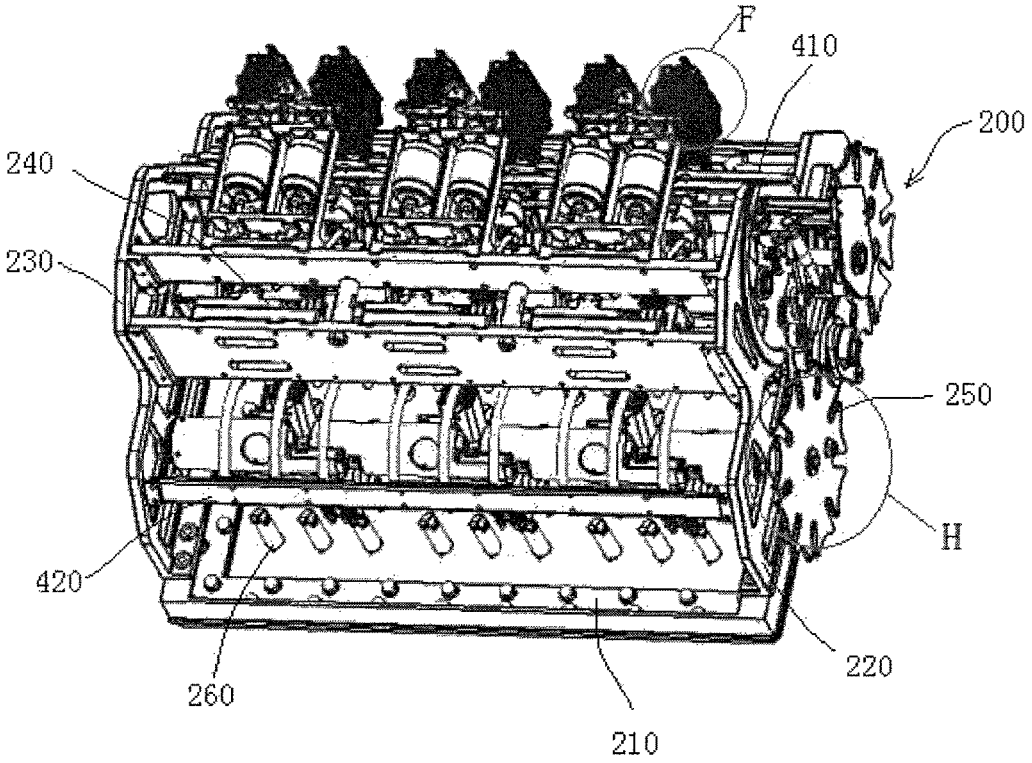
FIG. 9A is a vertical view of e switch body according to the present invention.
Figure 9B:
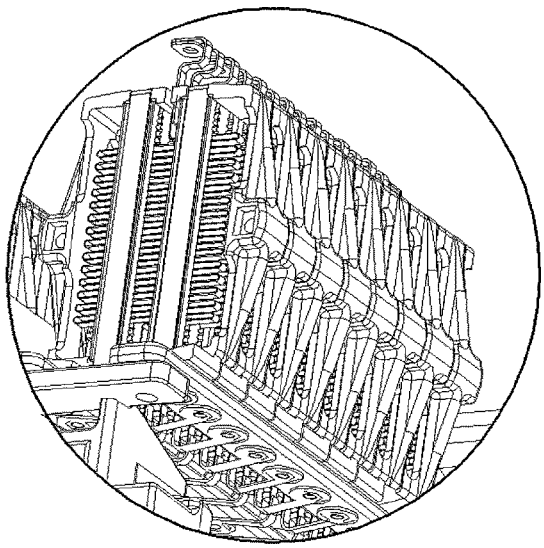
FIG. 9B is an enlarged view of F in FIG. 9A.
Figure 9C:
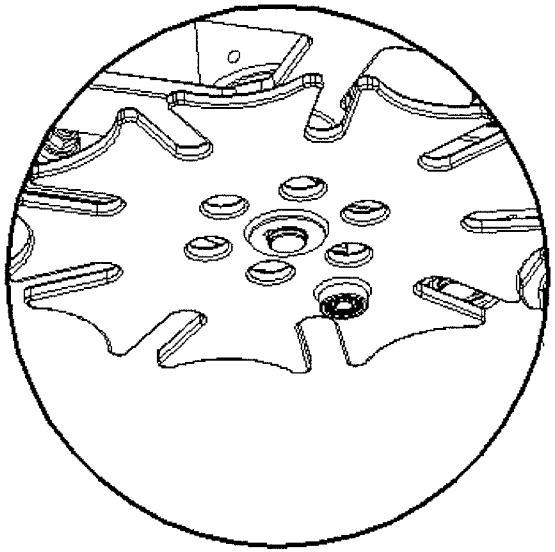
FIG. 9C is an enlarged view of H in FIG. 9A.
Figure 10A:
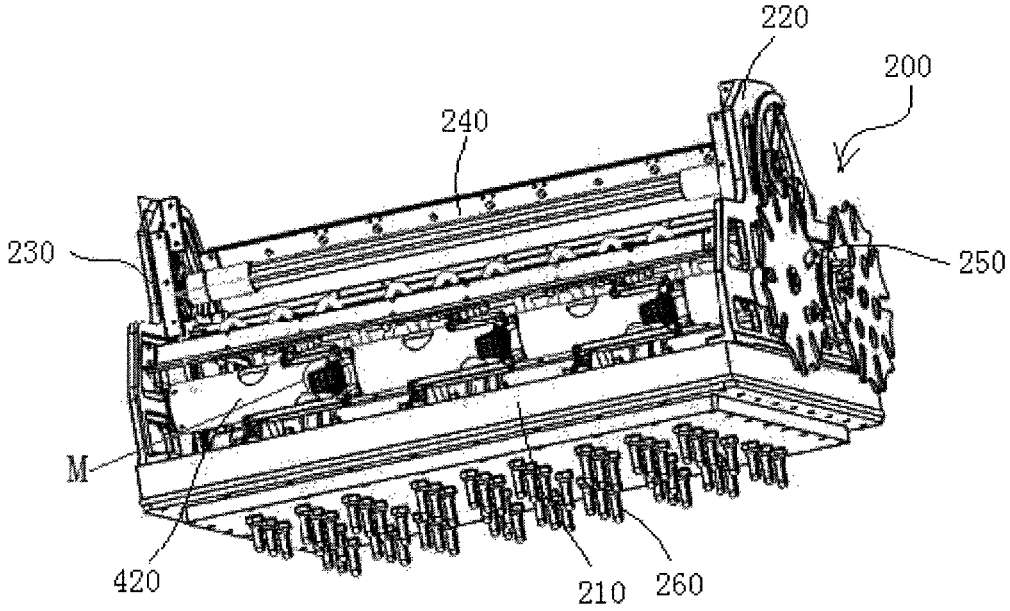
FIG. 10A is a schematic view of the switch body viewed diagonally above according to the present invention.
Figure 10B:
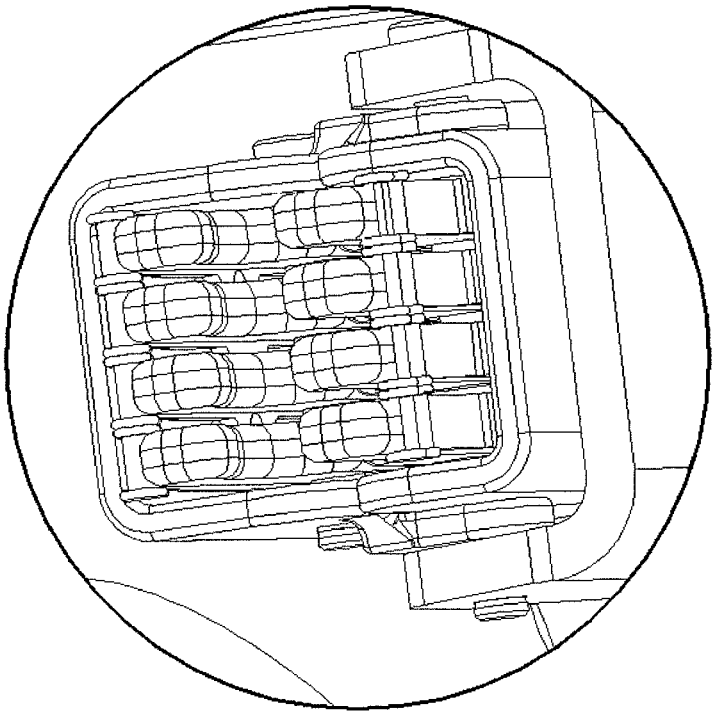
FIG. 10B is an enlarged view of M in FIG. 10A.

Referring to FIG. 1, FIG. 2 and FIG. 3, the external on-load tap changer includes a switch box 100, a switch body (core) 200 and a motor mechanism 300.

The switch box 100 consists of a top box wall 110, a front box wall 120, a rear box wall 130, a left box wall 140, a right box wall 150 and a bottom box wall 160 as well as a top box cover 170 and a front box cover 180. The top box wall 110 is opened with a rectangular top opening 111, to facilitate lift-in and lift-out of the switch body 200. The top box cover 170 is mounted on the top opening 111 with a fastener.

For ease of installation, the front box wall 120 is opened with a rectangular front mounting port 121, and the front box cover 180 is mounted on the front mounting port 121 with a fastener. Additionally, the front box cover 180 may be mounted on the left box wall 140 through a hinge mechanism 180*a*. The front box cover 180 may be provided with a handle 181, to facilitate opening of the front box cover 180.

The present invention is characterized in that the switch body 200 is detachably mounted in the switch box 100 and is entirely lifted in and lifted out by the top opening 111.

To mount the switch body 200 in the switch box 100 in a detachable manner, referring to FIG. 3, the present invention fixes a switch body mounting plate 190 respectively on left and right sides of the rear box wall 130 of the switch box 100, and an upper portion of each switch body mounting plate 190 is opened with a combined mounting positioning hole.

The combined mounting positioning hole includes a round hole 191, a middle connecting slot hole 192 and a transverse curved hole 193, wherein the round hole 191 is located at the top of the combined mounting positioning hole, the middle connecting slot hole 192 is located at a middle position of the combined mounting positioning hole, the transverse curved hole 193 is located at the bottom of the combined mounting positioning hole, the middle connecting slot hole 192 connects the round hole 191 and the transverse curved hole 193, and an inner diameter of the round hole 191 is greater than widths of the middle connecting slot hole 192 and the transverse curved hole 193. In addition, an upper portion and a lower portion of each switch body mounting plate 190 are respectively provided with internal thread holes 194 and 195.

Referring to FIG. 5 to FIG. 10, the switch body 120 includes a bottom plate 210 and two vertical slabs 220 and 230 fixed on two sides of the bottom plate 210, a change-over switch 240 and a tap selector are disposed in a space consisting of the bottom plate 210 and the two vertical slabs 220 and 230, and the tap selection is divided into an odd number of sets of tap selectors 410 and an even number of sets of tap selectors 420. The bottom plate 210 is used for connecting a flange on the transformer, disposed outside the transformer oil tank, to form an external tap changer.

The change-over switch 240, the odd number of sets of tap selectors 410 and the even number of sets of tap selectors 420 are tapped by taking the two vertical slabs 220 and 230 as support; the change-over switch 240, the odd number of sets of tap selectors 410 and the even number of sets of tap selectors 420 are disposed in parallel in an axial direction and in a triangular relationship in a horizontal direction, the change-over switch 240 is above, and the odd number of sets of tap selectors 410 and the even number of sets of tap selectors 420 are below. The odd number of sets of tap selectors 410 and the even number of sets of tap selectors 420 are separately disposed on left and right sides or upper and lower sides below the tap selector 240.

An outer side of the vertical slab 220 is provided with a composite sheave mechanism 250 controlling actions of the change-over switch and the tap selector; the composite sheave mechanism 250 controls actions of the odd number of sets of tap selectors 410, the even number of sets of tap selectors 420 and the change-over switch 240 and a phase relationship between their actions.

The two vertical slabs 220 and 230 may be casted or welded by metallic materials, or be molded by insulating materials.

All terminal posts 260 in the external combined on-load tap changer of the transformer are mounted on the bottom plate 210, to facilitate connection with windings in the transformer. A vacuum contact assembly plays a transition role in the change-over switch 240.

A positioning nail 211 is disposed at a location of the bottom plate 210 corresponding to the combined mounting positioning hole on each switch body mounting plate 190, i.e., upper corner positions on left and right sides of the bottom plate 210 are each provided with a positioning nail 211. Additionally, bolt holes 212 and 213 are disposed at locations on the bottom plate 210 of the switch body 200 corresponding to the internal thread holes 194 and 195 on the upper portion and the lower portion of each switch body mounting plate 190. The positioning nail 211 includes a positioning nail disc 211*a* and a disc connecting rod portion 211*b* integrally formed, wherein the disc connecting rod portion 211*b* is fixed on the bottom plate 210 of the switch body 200; a diameter of the positioning nail disc 211*a* is greater than a diameter of the disc connecting rod portion 211*b*, widths of the middle connecting slot hole 192 and the transverse curved hole 193 but less than an inner diameter of the round hole 191, and the diameter of the disc connecting rod portion 211*b* is less than the widths of the middle connecting slot hole 192 and the transverse curved hole 193.

After the switch body 200 is hoisted in the switch box 100, the positioning nail disc 211*a* on the positioning nail 211 is first inserted into the round hole 191, and then the switch body 200 is put down, at this time, the disc connecting rod portion 211*b* may enter the transverse curved hole 193 along the middle connecting slot hole 192, as the diameter of the positioning nail disc 211*a* is greater than the width of the transverse curved hole 193, the switch body 200 is suspended on the switch body mounting plates 190 on the left and right sides, after the switch body 200 has been hoisted, the switch body 200 can be fixedly mounted in the switch box 100 by using bolts to pass through the bolt holes 212 and 213 on the bottom plate 210 of the switch body 200 to be screwed into the internal thread holes 194 and 195 on the switch body mounting plate 190 and tightened. Upon installation of the switch body 200, the motor mechanism 300 is installed on the right box wall 150 of the switch box 100, and an output shaft of the motor mechanism 300 is connected with the composite sheave mechanism 250 in the switch body 200, so that the motor mechanism 300 could drive the composite sheave mechanism 250 to operate. Finally, the top box cover 170 is mounted on the top opening 111 with a fastener.

In the case of maintenance, it is only necessary to remove the bolts, reversely hoist the switch body 200 (core), release the positioning dogs 211 on the upper corners of the left and right sides of the bottom plate 210 of the switch body 200 from the round hole 191 in the combined mounting positioning hole on the switch body mounting plate 190, and lift the switch body 200 (core) out of the switch box 100.

The above contents show and describe the basic principle, major features and advantages of the present invention. Persons skilled in the art should understand that, the present invention is not limited by the examples, the above examples and descriptions merely describe the principle of the present invention, various variations and improvements may be made to the present invention without departing from the spirit and scope of the present invention, and the variations and improvements should fall into the scope of the present invention for which protection is sought. The scope of the present invention is defined by the appended claims and equivalents thereof.

What is claimed is:

1. An external combined on-load tap changer, comprising: a switch box, a switch body and a motor mechanism, a top box wall of the switch box being opened with a top opening, a top box cover being mounted on the top opening, characterized in that, the switch body is detachably mounted in the switch box and is entirely lifted in and lifted out by the top opening; and the motor mechanism is connected with the switch body in a driving manner wherein a rear box wall of the switch box is provided with at least two switch body mounting plates, an upper portion of each switch body mounting plate is opened with a combined mounting positioning hole; the switch body has a bottom plate, a positioning nail is disposed at a location of the bottom plate corresponding to the combined mounting positioning hole on each switch body mounting plate; and the switch body is mounted in the switch box, the positioning nail is hanged in the combined mounting positioning hole.

2. The external combined on-load tap changer according to claim 1, characterized in that, a front box wall of the switch box is opened with a front mounting port, and a front box cover is mounted on the front mounting port.

3. The external combined on-load tap changer according to claim 2, characterized in that, one side of the front cover is mounted on the switch box through a hinge mechanism.

4. The external combined on-load tap changer according to claim 1, characterized in that, the number of the switch body mounting plate is two, and the two switch body mounting plates are respectively fixed on left and right sides of the rear box wall of the switch box.

5. The external combined on-load tap changer according to claim 1, characterized in that, the combined mounting positioning hole comprises a round hole, a middle connecting slot hole and a transverse curved hole, wherein the round hole is located at a top of the combined mounting positioning hole, the middle connecting slot hole is located at a middle position of the combined mounting positioning hole, the transverse curved hole is located at a bottom of the combined mounting positioning hole, the middle connecting slot hole connects the round hole and the transverse curved hole; the positioning nail comprises a positioning nail disc and a disc connecting rod portion integrally formed, wherein the disc connecting rod portion is fixed on the bottom plate of the switch body; a diameter of the positioning nail disc is greater than a diameter of the disc connecting rod portion, widths of the middle connecting slot hole and the transverse curved hole but less than an inner diameter of the round hole, and the diameter of the disc connecting rod portion is less than the widths of the middle connecting slot hole and the transverse curved hole.

6. The external combined on-load tap changer according to claim 5, characterized in that, an upper portion and a lower portion of each switch body mounting plate are respectively provided with internal thread holes, bolt holes are disposed at locations on the bottom plate of the switch body corresponding to the internal thread holes, and the switch body can be fixedly mounted in the switch box by using bolts to pass through the bolt holes on the bottom plate of the switch body to be screwed into the internal thread holes on the switch body mounting plate and tightened.

7. An external combined on-load tap changer, comprising: a switch box, a switch body and a motor mechanism, a top box wall of the switch box being opened with a top opening, a top box cover being mounted on the top opening, characterized in that, the switch body is detachably mounted in the switch box and is entirely lifted in and lifted out by the top opening; and the motor mechanism is connected with the switch body in a driving manner, wherein the switch body comprises a bottom plate and a first vertical slab and a second vertical slab fixed on two sides of the bottom plate, a change-over switch and a tap selector are disposed in a space consisting of the bottom plate as well as the first vertical slab and the second vertical slab, and the change-over switch and the tap selector are supported by the first vertical slab and the second vertical slab; an outer side of the first vertical slab is provided with a composite sheave mechanism controlling actions of the change-over switch and the tap selector; the bottom plate is provided with terminal posts; and the composite sheave mechanism is connected with the motor mechanism in a driving manner.

8. The external combined on-load tap changer according to claim 7, characterized in that, the tap changer and the tap selector are disposed in parallel in an axial direction and in a triangular relationship in a horizontal direction, the change-over switch is above, and the tap selector is below.

9. The external combined on-load tap changer according to claim 8, characterized in that, the tap selector comprises an odd number of sets of tap selectors and an even number of sets of tap selectors, the odd number of sets of tap selectors and the even number of sets of tap selectors are disposed in parallel in an axial direction and are separately disposed on left and right sides or upper and lower sides below the tap selector.

10. The external combined on-load tap changer according to claim 8, characterized in that, the composite sheave mechanism controls actions of an odd number of sets of tap selectors, an even number of sets of tap selectors and the change-over switch and a phase relationship between their actions.

11. The external combined on-load tap changer according to claim 7, characterized in that, the first vertical slab and the second vertical slab are casted or welded by metallic materials.

12. The external combined on-load tap changer according to claim 7, characterized in that, the first vertical slab and the second vertical slab are molded by insulating materials.

13. The external combined on-load tap changer according to claim 7, characterized in that, a vacuum contact assembly plays a transition role in the tap changer.

14. The external combined on-load tap changer according to claim 8, characterized in that, the first vertical slab and the second vertical slab are casted or welded by metallic materials.

15. The external combined on-load tap changer according to claim 9, characterized in that, the first vertical slab and the second vertical slab are casted or welded by metallic materials.

16. The external combined on-load tap changer according to claim 10, characterized in that, the first vertical slab and the second vertical slab are casted or welded by metallic materials.

17. The external combined on-load tap changer according to claim 8, characterized in that, the first vertical slab and the second vertical slab are molded by insulating materials.

* * * * *